343-872
6/21/77 XR 4,031,537 SR

United States Patent [19]
Alford

[11] 4,031,537
[45] June 21, 1977

[54] COLLINEAR DIPOLE ARRAY WITH REFLECTOR

[76] Inventor: Andrew Alford, 120 Cross St., Winchester, Mass. 01890

[22] Filed: Oct. 23, 1974

[21] Appl. No.: 513,587

[52] U.S. Cl. ..... 343/704; 343/801; 343/818; 343/872; H01Q/19/10

[51] Int. Cl.[2] ..... H01Q 1/02; H01Q 9/20

[58] Field of Search ..... 343/704, 806, 810, 817, 343/818, 819, 827, 840, 846, 872

[56] References Cited

UNITED STATES PATENTS

| | | | |
|---|---|---|---|
| 1,874,983 | 8/1932 | Hansell | 343/840 X |
| 3,375,525 | 3/1968 | Fisk et al. | 343/806 X |
| 3,541,564 | 11/1970 | Fisk | 343/806 X |
| 3,680,147 | 7/1972 | Redlich | 343/840 X |
| 3,805,017 | 4/1974 | Roberts et al. | 343/704 X |

*Primary Examiner*—Paul L. Gensler

[57] ABSTRACT

This invention comprises an antenna array of collinear, end-fed dipoles spaced substantially less than one-quarter wavelength from the reflector. Consecutive dipoles are energized through phasing loops with the end dipole energized by a coaxial feeder or by one of the two output ports of a balun. A radome with a helically wound resistance heating wire is used to protect the array from the elements. Means comprising the addition of small auxiliary radiators at one of the ends of each dipoles are provided to reduce radiation polarized perpendicular to the axis of the array.

5 Claims, 10 Drawing Figures

FIG. 2c
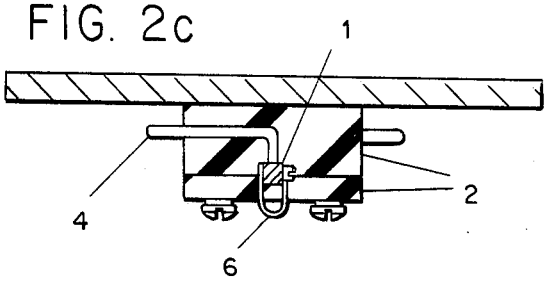
FIG. 2b
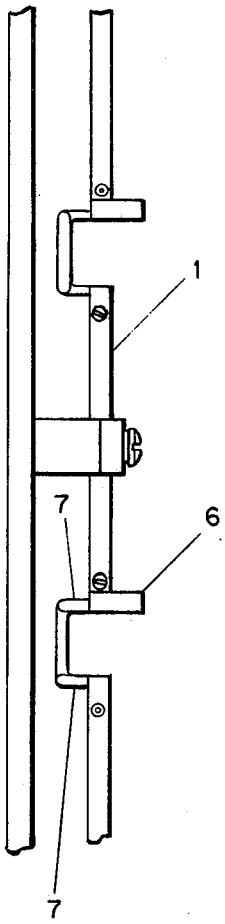
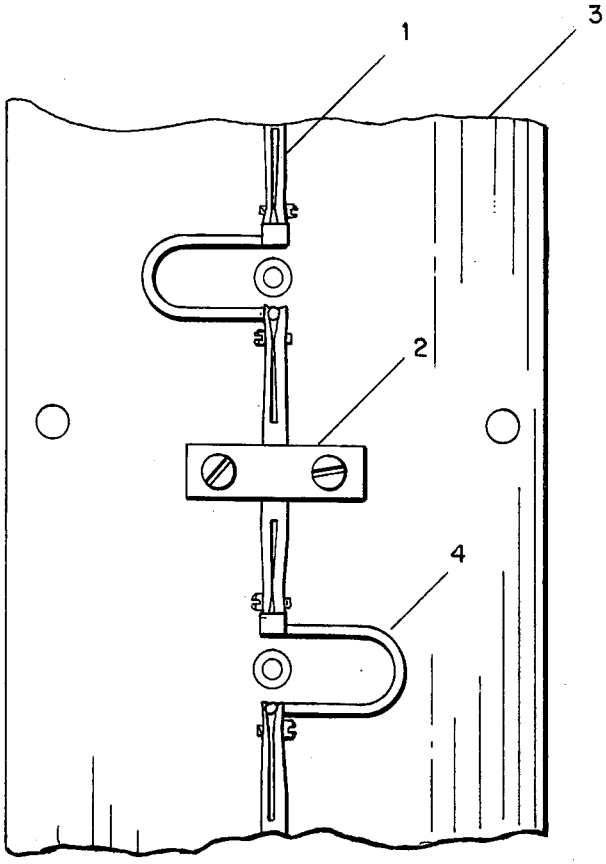
FIG. 2a

COLLINEAR DIPOLE ARRAY WITH REFLECTOR

DISCLOSURE

This invention relates to arrays of collinear dipoles mounted in the proximity of a reflecting metal sheet and energized by a single coaxial feeder. It is well known that when the frequency range over which an array is to be operated is relatively small, for example, a few percent of the center frequency, it is possible to energize a number of collinear dipoles by a single feeder by making use of phasing loops to transport power between adjacent dipoles.

I have observed that in a conventional array of this type with dipoles spaced approximately a quarter wavelength from the metal sheet, the relative power radiated by successive dipoles falls off very rapidly as one moves along the array away from the feed point, so that a long string of dipoles cannot be efficiently energized by a single feeder. Furthermore, the phasing loops also radiate a fraction of the total power. At least a portion of this radiation from the loops goes out in the form of waves polarized at right angles to the waves radiated by the dipoles. In some applications, such as cross polarized waves are very undesirable. The fact that only an array consisting of a few dipoles can be efficiently fed by a single feeder is uneconomical when operation over only narrow frequency range is required. When a collinear array is arranged so that the dipoles are vertical and the dipoles are placed in the vicinity of a flat metal plate with the phase loops arranged so that some parts of the loop conductors are horizontal, horizontally polarized signal is sent out in additon to vertically polarized signals from the dipoles. In a service, such as for example, instructional television, it is desirable to use the polarization of the waves as an additional means for discriminating between transmitting stations in the same area. When one station emits predominantly horizontally polarized radiation and another station emits predominantly vertically polarized radiation, interference can be reduced by using a linearly polarized receiving antenna. When, however, waves of both polarizations are radiated by one of the transmitting antennas, the discrimination by polarization at the receiving site is, at least, decreased in proportion to the cross polarized signal.

I find that linear dipole arrays using phasing loops can be used to radiate substantially pure linearly polarized waves provided that the phasing loops are properly arranged with respect to the reflecting sheet and further provided, that the dipoles are spaced at a distance of the order of a tenth of a wavelength from the reflecting sheet. The purity of polaraization can still be further improved by the use of small compensating radiators installed at one end of each dipole.

When collinear arrays are used at microwave frequencies, it is desirable to protect them from the elements. Even a small quantity of ice collecting on the dipoles, or on the phasing loops, is usually sufficient to disturb the phasing of the array.

Fiberglass radomes provide a means of keeping ice and water away from a dipole array. It is found, however, that should even a rather small thickness of ice stick to the radome in the form of a sheet, the transmission of signals from the array to the receiving point may suffer. For this reason, it is desirable to heat the radome in a uniform manner. I find that it is possible to wind resistance wire in a helix around a cylindrical radome without seriously affecting the radiation from a collinear array of dipoles arranged within the radome so that the axis of the array is parallel to the axis of the radome. The helical conductors should, however, make a nearly 90° angle with respect to the axis of the array in order to avoid substantial conversion of waves polarized parallel to the axis into wave polarized at right angles to it. After winding the helix made of resistance wire, the wire is covered with a thin layer of fiberglass to that the wires form a part of the radome shell. When a dipole array designed for a frequency around 2550 MHz (wavelength 4.63 inches) is placed within a radome about 11 inches in diameter, and the helix made of No. 20 A.W.G. Nichrome wire is wound with a three-quarter spacing between successive turns, it is found that the conversion from vertically to horizontally polarized waves by the helix is quite small.

By spacing the dipoles about one tenth of the wavelength from the metal panel, the radiation from individual dipoles is reduced so that a fairly large number of dipoles, for example 16, can be usefully energized by a single balun feeder which is fed by a coaxial line. Such a collinear array of 16 dipoles would consist of two groups of 8 dipoles, arranged symmetrically with respect to a centrally located balun.

These and other features of the invention will be explained in connection with the figures, amoung which:

FIGS. 1*a* and 1*b* show one embodiment of the invention.

FIGS. 2*a* 2*b* and 2*c* show details of individual dipoles, the compensating radiators and of the phasing loop.

Figure 1A:
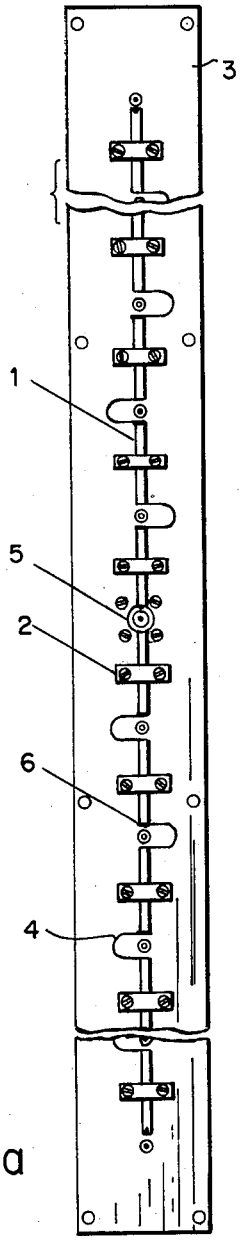
Figure 1B:
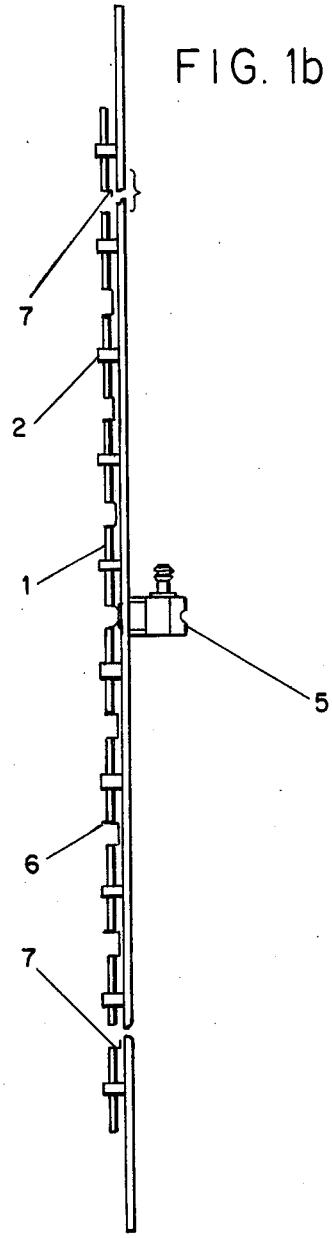

In FIG. 1 are shown two views of a collinear array of dipoles in accordance with one embodiment of the invention. This collinear array comprises two groups of dipoles such as 1 mounted by means of insulators 2 on a metal plate 3. Loops 4 made of metal rod or wire and bent into the shape of letter "U" with bent-over ends are used to phase the consecutively energized dipoles with respect to each other.

The two groups of dipoles are shown to be energized by a balun 5. A balun is used when two groups of collinear dipoles are to be energized from a centrally located feeder. When only one group of collinear dipoles is used and is energized from one end of a coaxial feeder, a coaxial line having a high characteristic impedance is convenient.

Metal pieces such as 6, hereafter referred to as compensating tabs that are relatively small in comparison with the long dimensions of the dipoles are electrically connected at those ends of the dipoles which feed the phasing loops. Radiation due to charging current flowing into the compensating tabs can be used to at least partically cancel the radiation from portions 7 of the phasing loops that are perpendicular to plate 3. The details of the compensating tabs as well as of some other parts of the array of FIG. 1 are shown in greater detail in FIG. 2.

The majority of the dipoles in the collinear array of FIG. 1 are called upon to perform two tasks: to radiate radio frequency power, and to transport power to the next dipole down the line. As a dipole moves closer toward the plate, less power is radiated by the dipole and more power is transported through it. The spacing between the dipoles and the plate should, therefore, be made smaller when a longer array is required and greater when a short array is desired. If spacing which is too large is chosen, the dipoles near the far end of the array will be supplied with so little power that the gain of the array will be substantially below what may be expected on the basis of its length. When the spacing is too small, a great deal of the power is transmitted to the ends and is reflected back to the feeder. This condition is undesirable because the phase of the reflected wave returned into the feeder varies very rapidly with frequency, making it difficult to obtain even an approximately matched input impedance over a frequency band only a few percent wide.

For a sixteen element array energized by a centrally located balun, a spacing of 0.08 wavelength between the center line of a dipole and the plate was found to be satisfactory. This spacing was used with dipoles 0.453 wavelength long, having a square cross section 0.035 ×0.035 wavelength. The phasing loops were made of brass rod 0.017 wavelength in diameter. The overall developed length of a phasing loop, not counting the portion inserted into a dipole was approximately 0.498 wavelength. The spacing between the ends of the dipoles was approximately 0.11 wavelength. It is preferably to make the dimension between the centerline of the dipoles and the plate between 0.15 and 0.04 wavelength. Other dimensions may be varied within limits. For example, the dipoles may be made round, hexagonal or of other shape. The effective diameter of the dipoles may be increased or decreased with some effect on the attenuation of power along the array. This effect may be compensated by changing the spacing between the dipole and the plate. The diameter of the loop wire is not critical, but the effective electrical length is.

The portions, such as 7 in FIG. 2, of the phasing loops which are perpendicular to the plate were approximately 0.03 wavelength long. The compensating tabs, such as 6 in FIG. 2, measured approximately 0.041 wavelength between the surface of the dipole and the top of the curved surface. This distance is measured in the direction normal to plate 3. The width of the tab measured in the direction of the axis of the array was also 0.041 wavelength. It makes little difference if a tab is hollow or solid.

The array in the example radiated a beam, which in the plane passing through the axis of the array had a half power beam width around 70°. In the plane at right angels to the axis, the beam width depended to some degree on the width of the plate 3 in FIG. 1. With a plate 0.9 wavelength wide, the beam width was around 80°.

Figure 3:
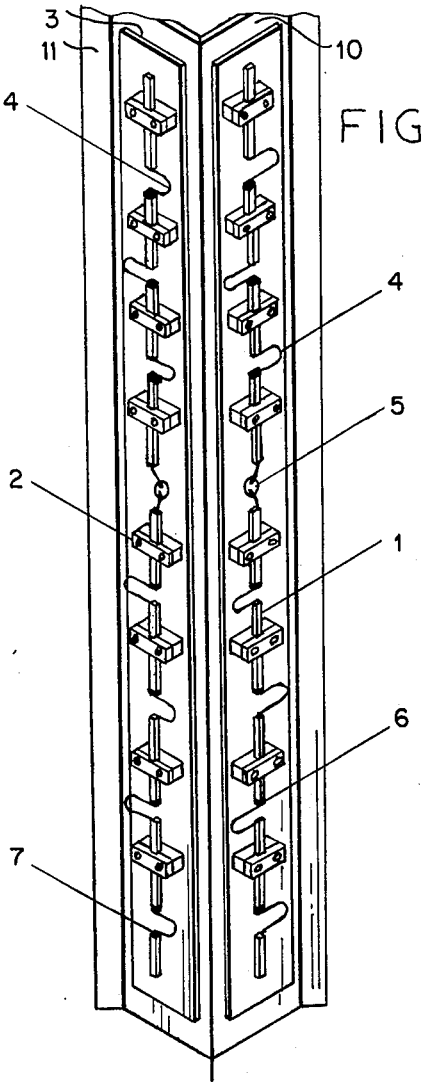
FIG. 3 shows a group of two collinear dipole arrays used as in a directional antenna.

When two such arrays are arranged as in FIG. 3 with the included angle between the adjacent plates being around 90°, and the two arrays are operating in the same relative phases, a beam about 160° wide is obtained in the phase perpendicular to the axis of the double array. With four arrays, an omnidirectional pattern may be had. With three arrays, about a 240° coverage may be obtained. The shapes of the radiation patterns are dependent on the shapes of the cross sections of the supporting panels. For example, with triplane reflectors shown in FIGS. 3&4 the radiation pattern may be made more uniform. In these reflectors the center portion, such as 10 in FIGS. 3&4, was made about 0.9 wavelength wide and bent over portions, such as 11 in FIGS. 3&4 were made 0.27 wavelength wide.

Figure 5:
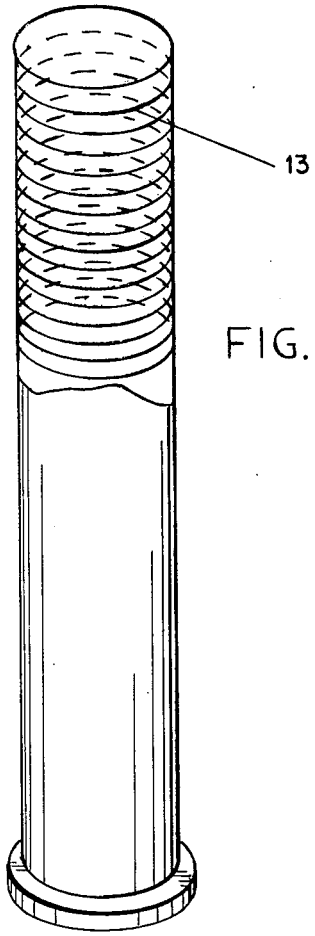
FIG. 5 shows details of a cylindrical radome with a heating wire wound around the radome in the form of a helix.

In FIG. 5 is shown a cylindrical radome mde of fiberglass around which is wrapped a resistance wire 13 in the form of a helix. One end of the wire shown near the flange is made available for connection inside the radome near the bottom of the radome. The upper end of the helix wire is returned by a straight copper wire running from the top of the helix down to the bottom of the radome. It is convenient to cover the helix with a layer of fiberglass cloth and apply polyester or epoxy to the cloth so as to form a thin layer of fiberglass over the wire. Epoxy or polyester are applied in fluid form, but become solid after a passage of time or heating due to polymerization.

Figure 4:
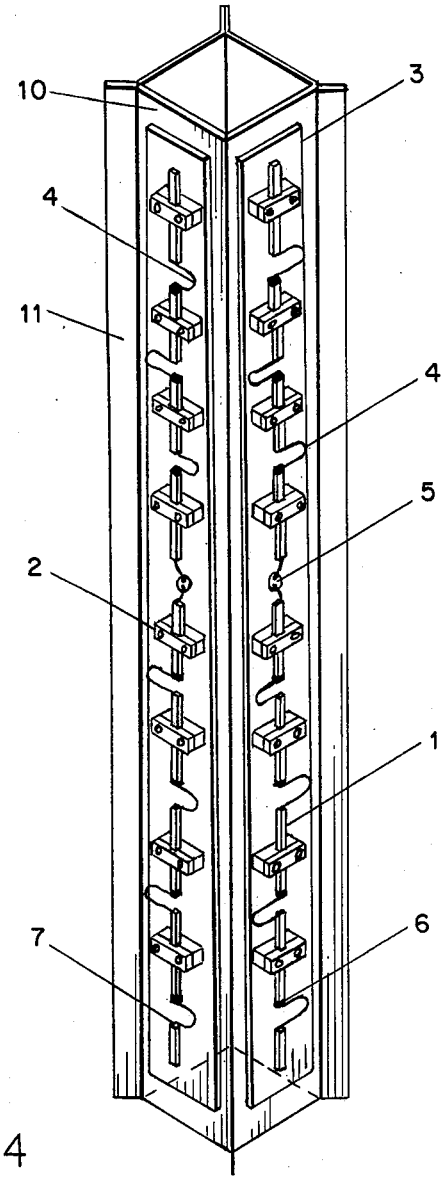
FIG. 4 shows a group of four collinear dipole arrays used to produce an omnidirectional radiation pattern in the plane perpendicular to the axes of the dipole array.

Several coils of wire may be wound one above the other on the radome with each helix heating its portion of the radome. In this case, the connecting copper wires may be all returned on the same side of the radome close to each other. Such an arrangement may be used when the array is intended to be directional and the vertical feeding wires are in the region of minimum radiation. When an omnidirectional antenna such as one shown in FIG. 4 is to be protected, the vertical feeding wires for the helical windings are preferably returned along those parts of the radome which are very close to the continuations of the ribs such as 11 in FIG. 4, where the RF field along the wires would be relatively small so that they would have only minor effect on the radiation pattern.

Figure 6:
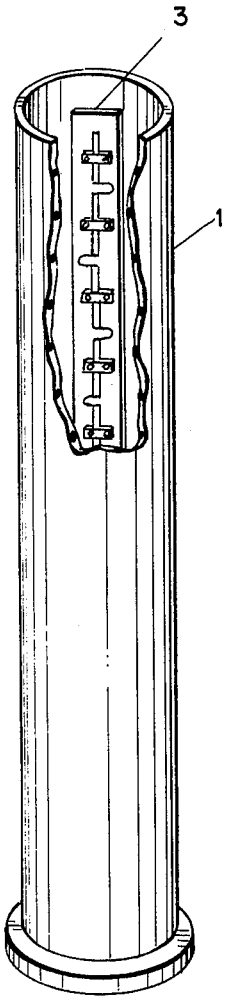
FIG. 6 shows a collinear array protected by a heated radome.

FIG. 6 shows a collinear array protected by a heated radome 12.

Figure 7:
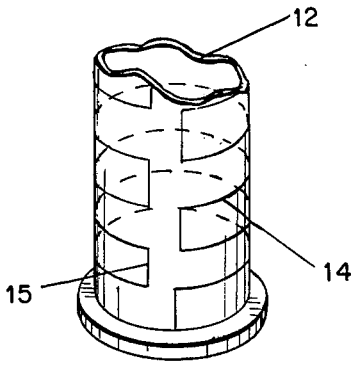
FIG. 7 shows another arrangement of wires for heating a radome intended to protect an antenna array used for radiating or receiving linearly polarized waves.

When the antenna protected by a cylindrical radome is directional, heating wires may be wound so that the winding consists of wire wound around the cylindrical radome in planes perpendicular to the electric field. The connections 15 between the successive loops 14 are made in the sector or sectors whre the electric field is low as illustrated in FIG. 7.

The embodiment of the present invention described herein, represents the best known use of the invention and incorporates the principal features of the invention. Various modifications in construction, arrangement and operation of the apparatus illustrated in this embodiment can be made within the scope and spirit of the invention set forth in the appended claims.

I claim:

1. An antenna array comprising a collinear chain of dipoles, a reflecting plate, phasing loops connected between consecutive dipoles and located on the same side of the reflecting plate as the dipoles "said phasing loops having major portions substantially parallel to said reflecting plate", means for spacing the dipoles from the reflecting plate less than a quarter wavelength at the operating frequency, means for spacing the phasing loops at a smaller distance from the plate than the dipoles and means for energizing said chain of dipoles from one end.

2. An antenna array as in claim 1 wherein the spacing between the axes of the dipoles and the reflecting plate is between 0.15 and 0.04 wavelength at the operating frequency.

3. An antenna array as in claim 2 wherein the spacing of the phasing loops from the plate is 0.03 wavelengths less than the spacing between the dipoles and the plate.

4. An antenna array as in claim 1 wherein auxiliary radiators substantially 1 25th of the wavelengths long are added to one end of each dipole whereby cross polarized radiation is reduced.

5. An antenna array in accordance with claim 1 enclosed in a cylindrical radome made of electrically insulated material and comprising a helically wound heating wire wherein the radome heating wire returns are located in the regions of minimum radiation.

* * * * *